US006629918B2

(12) United States Patent
Mesa

(10) Patent No.: US 6,629,918 B2
(45) Date of Patent: Oct. 7, 2003

(54) CENTRIFUGE ADAPTER

(75) Inventor: Carlos Guillermo Mesa, Buenos Aires (AR)

(73) Assignee: Carlos G. Mesa (AR)

( * ) Notice: Subject to any disclaimer, the term of this patent is extended or adjusted under 35 U.S.C. 154(b) by 0 days.

(21) Appl. No.: 09/862,143

(22) Filed: May 21, 2001

(65) Prior Publication Data

US 2002/0173415 A1 Nov. 21, 2002

(51) Int. Cl.[7] ..... B04B 5/02; B01L 3/00
(52) U.S. Cl. ..... 494/21; 422/104
(58) Field of Search ..... 494/16, 20, 21, 494/33, 45, 85; 210/781, 782; 248/95; 422/102, 104

(56) References Cited

U.S. PATENT DOCUMENTS 3,674,197 A * 7/1972 Mitchell et al.
4,266,717 A * 5/1981 Jennings et al.
4,316,576 A 2/1982 Cullis et al.
4,413,771 A 11/1983 Rohde et al.
4,439,177 A * 3/1984 Conway
4,482,342 A * 11/1984 Lueptow et al.
4,543,084 A * 9/1985 Bailey
4,582,606 A 4/1986 McCarty
4,753,739 A 6/1988 Noble
4,892,668 A 1/1990 Harmony et al.
4,909,949 A 3/1990 Harmony et al.
5,158,749 A * 10/1992 Eberle
5,295,943 A 3/1994 Romanauskas et al.
5,395,001 A 3/1995 Moore
5,399,144 A 3/1995 Romanauskas et al.
5,549,540 A 8/1996 Moore et al.
6,019,716 A 2/2000 Forestell et al.
6,296,212 B1 * 10/2001 Monahan

OTHER PUBLICATIONS

Information Sheet, *Blood Component Therapy with RC–3*, date unknown.

* cited by examiner

*Primary Examiner*—Charles E. Cooley
(74) *Attorney, Agent, or Firm*—Watts Hoffmann Co., L.P.A.

(57) ABSTRACT

An adapter for supporting a flexible container in a cylindrical cavity of centrifuge carrier. The adapter is of a size that can be received in the cavity and comprises a wall comprised of a flexible material. The wall comprises a first concave wall portion having a first curvature and a second wall portion having a second curvature that is lower than the first curvature. The first wall portion is concave with reference to the flexible container. The first wall portion and the second wall portion are diametrically opposed to each other so as to receive the flexible container in an interior region substantially bounded by an inner surface of the wall. The invention also pertains to a centrifuge including carriers which receive the adapter and to a method of using the adapter in a centrifuge to thaw contents of the flexible container.

18 Claims, 2 Drawing Sheets

CENTRIFUGE ADAPTER

FIELD OF THE INVENTION

The present invention relates to centrifuges and, in particular, to the balancing of centrifuges during thawing of frozen materials.

BACKGROUND OF THE INVENTION

A typical bloodbanking refrigerated centrifuge 2 is shown in FIG. 1 and includes a rotatable rotor 4. Buckets or carriers 6 are pivotally connected to the rotor. This particular centrifuge employs a lid 8 which permits high speed rotation. The carriers swing on axis A—A and assume a horizontal position during centrifuge operation as a result of centrifugal forces caused by spinning of the rotor.

In early centrifuge usage, blood was collected in glass bottles which were placed in cylindrical centrifuge carriers. The bottles were prone to breakage and made decanting liquid a difficult task. This lead to the use of flexible containers or bags in centrifugation. Bags are more convenient in handling and withstand mishaps such as falls much better than glass bottles.

The contents of a centrifuge are to be placed in radial symmetry to the axis of rotation to achieve an approximate balance of masses. The material to be centrifuged is first statically balanced, such as through the use of a two-plate balance, to achieve the same weight in each container. Typically, water is added to increase the weight of a container. Then, the balanced containers are placed in diametrically opposed relationship on the rotor. Therefore, the number of carriers is, for example, four or six rather than an odd number.

Centrifuges evolved into high speed machines. The bags did not always perfectly fit the carriers and ruptured at high pressures. Also, doctors differed in the volume of contents placed in each bag.

Centrifuge adapters were placed in the carriers to simplify operation and avoid bag breakage. Also, adapters were used to place all sorts of small containers, such as "Radio Immuno Assay" test tubes in the carriers, to enhance the usefulness of the centrifuge around the laboratory.

Adapters have a rigid construction which is intended to keep the contents safe during the centrifuge run. Some adapters help the centrifuge operator with a difficult part of the separation: taking the centrifuged goods out of the carriers and decanting the supernatant liquid without mixing it with the separated cell packets or pellets. Other adapters prevent whole blood from remaining in the pleats at the top part of the bags, caused when tubing of the bag is placed into the carrier.

Adapters such as those described in U.S. Pat. Nos. 5,549,540 and 4,582,606, employ elliptical cavities defined by rigid walls for separation of liquid/cell combinations. However, such elliptical adapters, as well as cylindrical (circular) adapters, exhibit problems when used on frozen material. Ice clumps that separate from the frozen mass tend to "float" to sections of the container at lower pressure. The liquid resulting from the melting of the frozen masses flows to high pressure areas replacing their volume. All this happens in an aleatory or haphazard manner in circular and elliptical adapters, whether bags or bottles. Also, the adapters, by virtue of their rigid construction, may rupture bags when ice clumps push against the inner walls of the flexible container supported by the rigid walls. This is a major cause for growing imbalance problems and risk to operator and machine during the run.

The medical community could benefit greatly from safe operation of a centrifuge which prevents flexible bag rupture, especially in the case of thawing frozen contents by centrifuging. Such safe operation should enable centrifuges to be used to thaw biomaterial while avoiding splashing (such as in the case of blood). Other areas that could benefit are blood banks in that they could quickly prepare their own fresh Cryoprecipitated AHF in advance during normal blood bank operation. Summer shortage cases would be solved by the safe use of centrifuges for thawing as would emergency cases by on-the-spot donation by volunteers. Independent operation from commercial blood clotting concentrates for any special reason would be possible. More flexible care of hemophilia, von Willebrand's disease and other low blood clotting diseases would be possible. Also, new possibilities of investigation may occur as new mixtures of biomedical compounds can be made and studied.

SUMMARY OF THE INVENTION

In general, the invention pertains to an adapter for supporting a flexible container or bag in a centrifuge carrier. The adapter is of a size that can be received in a cylindrical cavity of the carrier and comprises a wall formed of a flexible material. The wall comprises a first concave wall portion or section having a first curvature and a second wall portion or section which has a second curvature that is lower than the first curvature. The first wall portion and second wall portion are diametrically opposed to each other so as to receive the flexible container in an interior region substantially bounded by an inner surface of the wall.

In all embodiments of the present invention, it will be appreciated by those skilled in the art that reference to the wall "substantially bounding" the crescent shaped interior region (or interior region between the first concave wall portion having a first curvature and diametrically opposed second wall portion having a lower curvature than the first curvature) includes within its scope walls which do not completely surround the flexible bag that they shape. In a preferred embodiment the interior of the adapter wall completely surrounds the interior region.

More specifically, the invention is directed to an adapter formed of a flexible material. The first and second sections are fastened by a hinge. A latch interconnects the first and second sections together. This two-part adapter may include a plurality of latch openings to adjust the size of the interior region. Flexible containers thus may be contacted with even pressure by the adapter and placed in the resulting shape without room for substantial movement within the interior region of the adapter, regardless of the volume of the flexible container and its contents. In this disclosure, the term "flexible" in regards to the adapter wall, means material which is suitable to withstand freezing of the liquid components of the flexible container and allows flexure of the flexible container during thawing effective to avoid rupture of the flexible container. For example, the adapter should allow a maximum linear dimension distortion of the wall ranging from 0.3 to 1.0 mm when freezing or thawing the bag contents.

In particular, the adapter includes the first concave wall portion and a second convex wall portion having a larger curvature radius (i.e., lower curvature) than the first wall portion, the first and second wall portions being diametrically opposed to each other. The radius of curvature of the first higher curvature, concave wall portion approximates the radius of curvature of the centrifuge carrier, for example, to within a tolerance on the order of 5–10 mm to allow easy setting of the loaded adapter. In this way, the curvature provides a sufficient hold for practical purposes and allows for easy handling of the adapter. Centrifugal force will suffice to retain the adapter in position during centrifugation. The radius of curvature of the low curvature wall portion is, for example, 3 to 4 times the radius of curvature of the high curvature wall portion. As a practical matter it is expected that the adapter will seldom be used alone in a carrier as a second bag can usually be placed in the carrier along with the bag carried by the adapter.

Until now, accelerated thawing of biological material such as plasma or other liquid placed in a flexible container by means of centrifugation, resulted in severe mechanical overload in the centrifuge because of the imbalance created during the run. This put the machine and its operator at risk.

Placing of frozen material in the centrifuge poses no risk as the solid filled soft containers (such as bags) are placed in the carriers and the usual static balancing procedure is followed. This usual practice implies that mass distribution around the axis of rotation is approximately correct, that other changes in mass distribution will not occur or will be negligible during the centrifuge run and that the machine will absorb or compensate for the small imbalance resulting from inevitable displacement from the original position of the contents being centrifuged.

Dynamic balancing of the centrifuge load (i.e., balancing during the run) is difficult for the operator to achieve, as it implies a procedure far more complicated than the static balancing carried out with a standard balance and water (or other media) to equalize the weight of the carriers.

The deformation of the centrifuged material due to the aleatory movement of frozen masses and resulting liquids is a cause of severe dynamic imbalance in the centrifuge and this especially happens in the case of soft containers such as blood donation bags. When solid material contained in the soft container melts down, the resulting liquid flows to a different position than the one it originally had, generating imbalance during the run.

This aleatory movement of frozen masses and liquids is typical of cylindrical and elliptical adapters. Rigid adapters or devices that are used in the separation of liquids and cell packets are unsuitable for thawing biomedical material by centrifugation because they allow for the free movement of frozen masses against the walls of the rigid adapter containing the soft container, and these frozen masses are likely to produce imbalance and breakage of the rigid container. Although the use of flexible adapters has been considered, the flexible container or bag is permitted to assume an elliptical or cylindrical (round) shape, allowing for free movement of frozen masses and liquids during centrifugation with corresponding imbalance.

Although the application of high acceleration during melting of frozen material desirably increases the speed and the amount of material being melted, it aggravates the problem of imbalance detection and machine stoppage. Many centrifuges are equipped with an imbalance detector of some kind. However, in some cases this is unable to solve the problem, as the increase of dynamic imbalance is too quick and may create damage even during the coasting period (from full speed to a complete stop).

One use of the present invention applies to the separation of Cryoprecipitated AHF from whole human blood. It is a usual practice to extract blood from donors and place it in a transfusion bag. The bag is equipped with tubing to decant the separated parts into one or two separate bags, in one or more stages of centrifugation and following additional procedures. To obtain Cryoprecipitated AHF for haemophilic patients, for example, the whole blood is centrifuged to separate the red cell packet, and the resulting platelet-poor plasma is decanted into a second bag. The second bag is separated from the one containing the red cells and sealed. Following the procedure the bag of platelet poor plasma is deeply frozen in a liquid medium at temperatures around or below −70° C. This provides for a quick freezing and the separation of the Cryoprecipitated AHF at the solid-liquid interface. Resulting from this procedure is a bag of frozen plasma plus the separated Cryoprecipitated AHF immobilized in the frozen plasma. Until the present invention, this bag was placed in a 4° C. or higher temperature deposit and allowed to thaw for about 24 hours. The Cryoprecipitated AHF resulted as a viscous precipitate.

Using the present invention the above procedure is modified whereby the bag of platelet poor plasma is placed in the adapter and conformed into a shape by contact with the adapter wall. This is then deeply frozen in the known manner. When needed, the adapter(s) with frozen contents is placed in a centrifuge and thawed quickly (filling other carriers if needed and statically balancing the centrifuge) in accordance with the present invention, which greatly shortens the time needed to form Factor VII Rich Cryoprecipitate.

The use of moderate acceleration to thaw material such as blood or components thereof typical of bloodbanking centrifuges (e.g., around 2000 to 3000 G's, wherein G is the acceleration of gravity) reduces the thawing time from 24 hours to about 35 minutes, for example. The safe application of acceleration by centrifuge is made possible by the use of the present invention.

Referring to a general method of the present invention for thawing frozen contents of flexible containers in a centrifuge, the frozen flexible container is contacted with an interior wall of an adapter whereby the container conforms to a crescent shape of an interior region substantially bounded by the wall. The adapter is received in a cylindrical cavity of a carrier. While the flexible container contacts the interior wall of the adapter the rotor is rotated so as to thaw the frozen contents in an ordered manner which maintains the dynamic balance of the centrifuge.

A more specific method of treating biological material contained by a flexible container in a centrifuge in accordance with the invention, comprises placing a flexible container containing liquid biological material in the interior region of an adapter. The adapter wall is pressed into contact with the flexible container so as to shape the flexible container into a crescent shape without space for substantial movement of the flexible container within the adapter. The flexible container and its biological material are frozen in shape. When needed for use, the adapter and the frozen flexible container are then placed in one of the carriers and the centrifuge is statically balanced. The rotor is rotated at a speed (RPM) and for a time sufficient to thaw the frozen contents. The adapter wall is pressed against the frozen flexible container while rotating the rotor, effective to order the thawing of the biological material according to the crescent shape and thereby maintain a dynamic balance of the centrifuge. The biological contents may comprise blood or a component thereof. In a more specific application the biological contents comprise platelet poor plasma in the production and use of Cryoprecipitated AHF.

Many additional features and a fuller understanding of the invention will be had from the accompanying drawings and the detailed description that follows.

DETAILED DESCRIPTION

Figure 4:
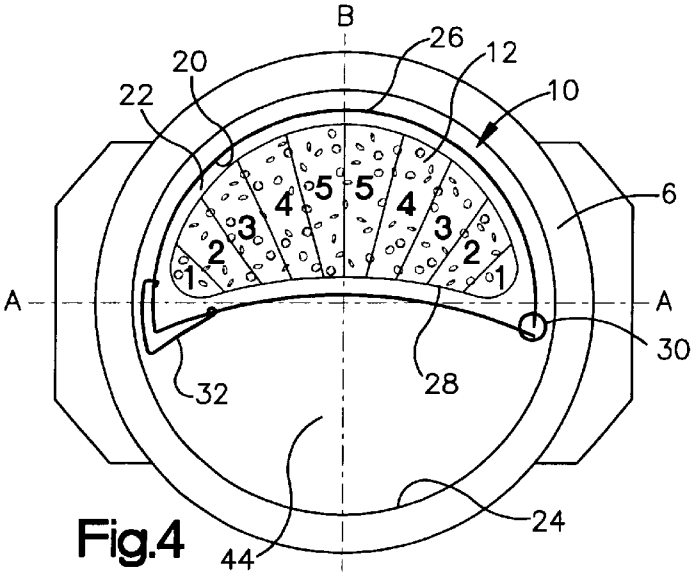
FIG. 4 is a top view of a centrifuge carrier utilizing an adapter constructed in accordance with the present invention.

Referring now to the drawings, the present invention is directed to an adapter shown generally at 10 for supporting a flexible container or bag 12 (FIG. 4) in the carrier 6. The carrier 6 is pivotally supported on the rotor 4 of the centrifuge 2 on axis A—A. Those skilled in the art will appreciate in view of this disclosure that the inventive adapter may be used in carriers and in centrifuges of different designs than the centrifuge 2. The adapter 10 comprises a wall 20 having an interior surface. The wall 20 substantially bounds (i.e., partially or completely bounds) a crescent shaped interior region 22 that can receive the flexible container or bag 12. The adapter is of a size that can be received in a cylindrical cavity 24 of the carrier (FIG. 4). It should be appreciated by those skilled in the art in view of this disclosure that the size of the flexible container 12 and of the adapter 10 can vary from what is shown in FIG. 4. FIG. 4 is presented without showing the flexible container 12 touching the adapter or the adapter touching the carrier 6, merely for ease of understanding. The container 12 is expected to touch the adapter in places, depending upon the stage of thawing, and the adapter would touch the carrier in places, depending on the stage of the centrifuge run.

The adapter is preferably formed of a flexible material such as sheet metal. Other suitable materials for the adapter are Kevlar™ brand ceramic and Teflon™ brand polytetrafluoroethylene. A preferred material of construction is stainless steel. The wall material allows a maximum linear distortion ranging, for example, from 0.3 to 1.0 mm, when freezing or thawing the bag contents. One suitable stainless steel is "18/8" or AISI 304. Suitable stainless steel gauges range from 23 to 18. The low and high curvature walls, hinge and latch may all be formed of stainless steel. The adapter has a smooth surface finish of, for example, 200 microinches or smoother, and is free from burrs, cutting edges and discontinuities.

The adapter is preferably removably inserted into the centrifuge carrier and has a simple design. This permits repeated use of the adapter and facilitates cleaning by autoclave. A single adapter would normally be used in a carrier, leaving room for accessories (i.e., tubing related to the bag or bags being centrifuged/thawed and other bag or bags that can usually be placed in the carrier to use centrifuge time for other purposes). For example, a carrier may normally receive two partially filled bags plus an empty bag and their tubing.

The adapter 10 preferably comprises a first concave high curvature wall section 26 and a diametrically opposed second low curvature (preferably convex) wall section 28 (see FIG. 4). Although the adapter wall is referred to as crescent shaped (i.e., it bounds a crescent shaped interior region or cross-sectional area) it will be understood by those skilled in the art in view of this disclosure that the invention admits of variations in the shape of the wall so long as the wall includes a concave high curvature wall portion and a diametrically opposed second wall portion with a lower curvature than the high curvature wall portion. The second wall portion may be a wall portion without curvature (e.g., the adapter having a "D" shape). The terms, concave and convex, are taken from the point of reference of the enclosed flexible container 12. It will be appreciated by those skilled in the art in view of this disclosure that the curvature of the first and second wall portions may vary from what is shown in the drawings.

Figure 2:
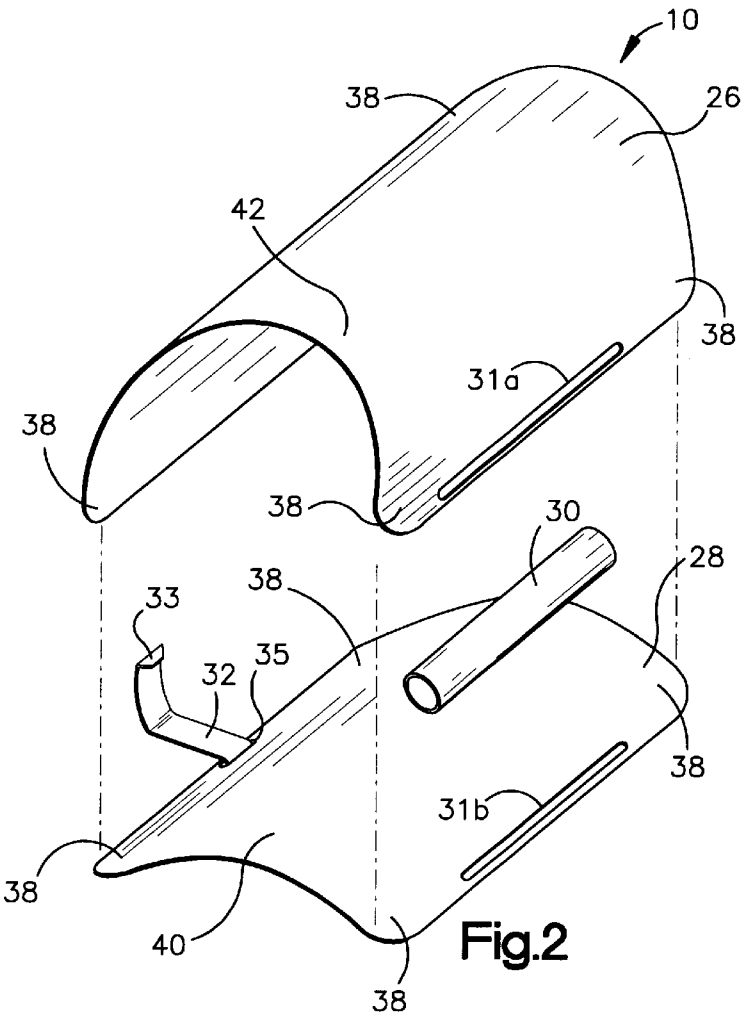
FIG. 2 is an exploded perspective view of an adapter constructed in accordance with the present invention.
Figure 1:
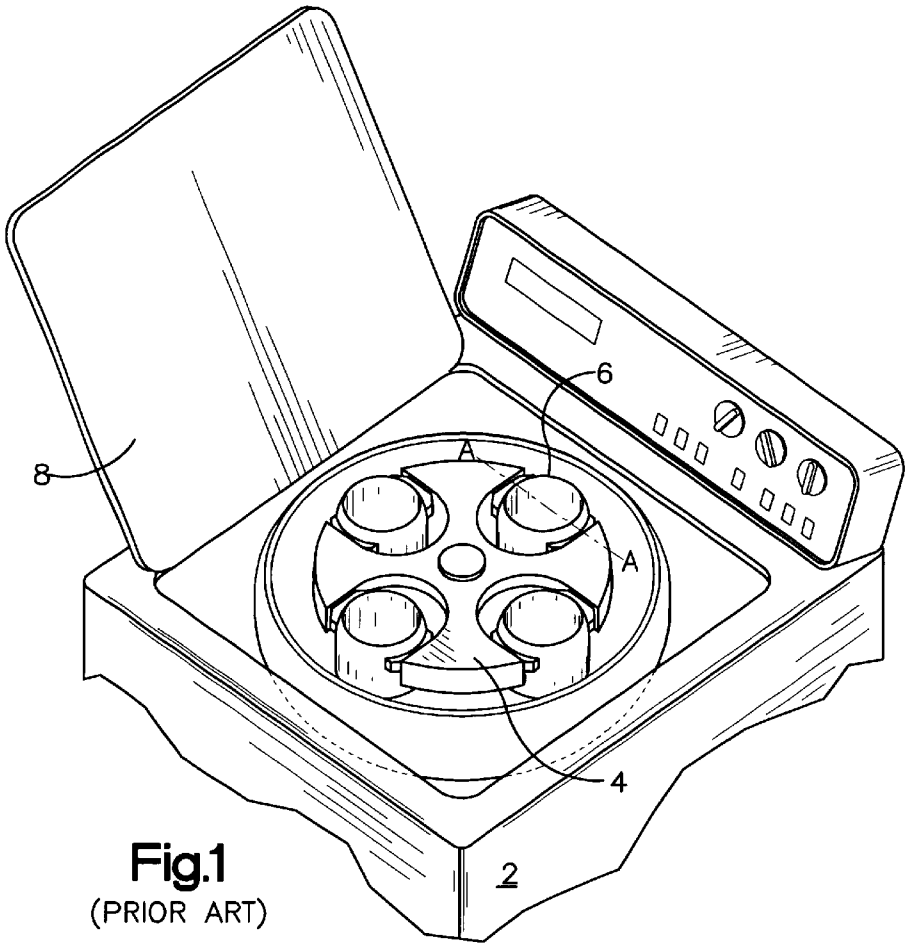
Fig.1 (PRIOR ART)
FIG. 1 is perspective view of a prior art centrifuge which may utilize the adapter of the present invention.

A hinge 30 (shown generally as a hollow cylinder in FIG. 2) extends inside openings 31*a*, 31*b* in the first and second sections and a latch 32 interconnects the first and second section together. The first section 26 includes a plurality of openings 34 (FIG. 5) into which the latch can be received for varying the size of the crescent shaped interior region. The walls, hinge and latch mechanism are constructed and arranged to produce an elastic, even pressure on the flexible container, without damaging the integrity of the flexible container. This avoids spillage and contamination of the contents of the flexible container. The hinge and latch mechanism enable the crescent shaped adapter wall to press evenly on the soft container to place it in a resulting shape (FIG. 4), leaving no room for further distortion of the shape of the soft container during freezing and thawing of the contents. Small changes in volume of the contents are absorbed by the elastic action of the first and second portions of the flexible container.

Figure 5:
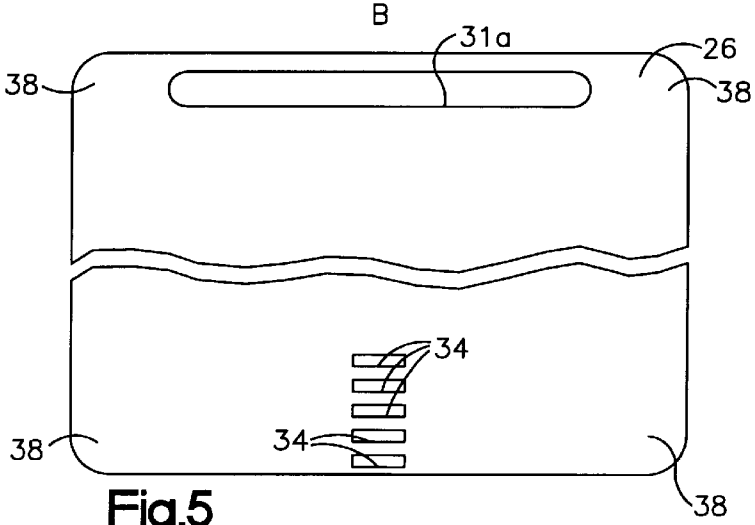
FIG. 5 is an elevational view of one section of an adapter constructed in accordance with the present invention.

FIG. 5 shows the high curvature first wall portion 26 in a flat condition before the curvature is provided to it. The curvature is applied to the flat first and second sections using known tools and techniques appropriate for the material used. The elongated opening or slot 31*a* receives the hinge mechanism. The elastic pressure exerted by the walls of the adapter may be adjusted by placing a hook 33 of the latch in a selected one of the openings 34. The other end of the latch is inserted in a slot 35 formed in the second section 28 and crimped in place. The wall of the first and second sections may have rounded corners 38 to reduce the possibility of damage to the flexible container.

Figure 3:
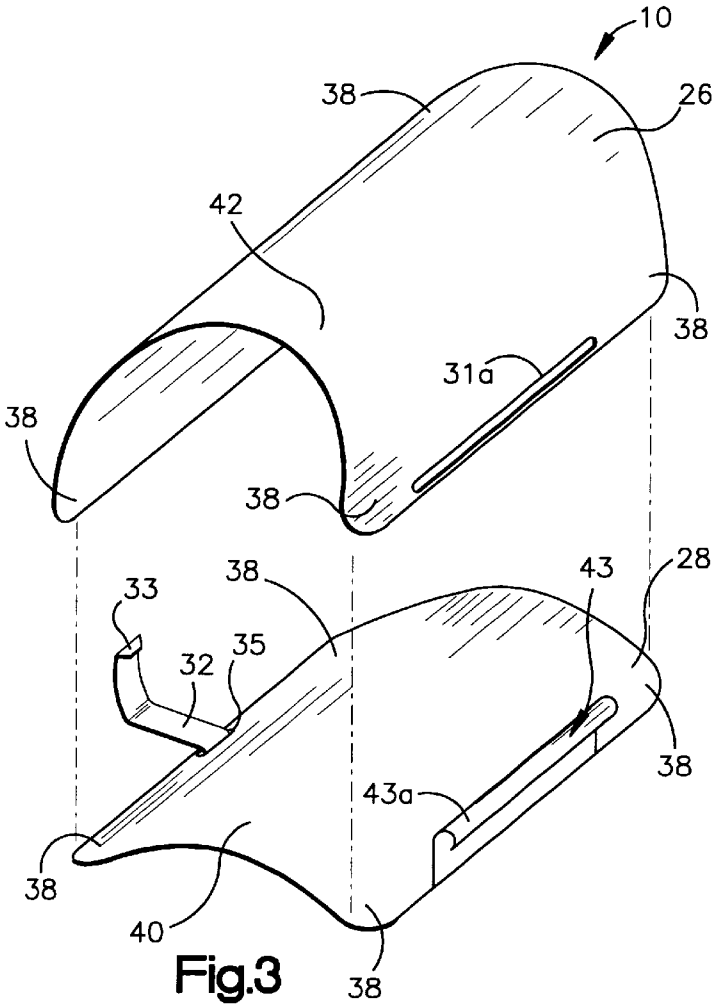
FIG. 3 is an exploded perspective view of another adapter constructed in accordance with the present invention.

Another hinge 43 is shown in FIG. 3, where like reference numerals designate like parts throughout the several views. The hinge 43 is formed or otherwise attached to section 28 and includes a curved male section or flap 43*a* which is received inside slot 31*a* of the section 26 to allow for relative movement between the first and second wall sections.

Carrier internal diameters typically range from 7.0 to 12.0 cm. The radii of curvature of the crescent shaped wall (e.g., the first and second wall portions) varies based on the diameter of the carrier that is used. For a carrier having an internal diameter of 10.0 to 11.0 cm, the radius of curvature of the high curvature wall 26 ranges, for example, from 4.90 to 5.10 cm. If a different sized carrier is used, the radius of curvature of the high curvature wall should be changed proportionally. The low curvature wall 28 has a radius of curvature which is, for example, 3 to 4 times the radius of curvature of the high curvature wall. For example, the low curvature wall has a radius of curvature of 15 to 25 cm for a carrier having an internal diameter of 10.0 to 11.0 cm.

Referring to FIG. 4, the swinging carriers freely pivot about the A—A axis during centrifugation. Axis B—B is the axis of centrifugal acceleration and coincides with the axis of symmetry of the cylindrical volume defined by the swinging buckets in operation, once the carriers have turned 90°.

The adapter of the present invention may be placed in only a portion of the interior volume of the carrier (as shown in FIG. 4). Free space 44 in the remainder of the carrier may receive tubing and other accessories. The amount of free space 44 depends upon the relative volumes occupied by the flexible container and cylindrical volume of the carrier. The flexible container 12 shown in FIG. 4 is shaped by action of the first and second wall portions. The adapter of the present invention functions as a press when the latch is closed, exerting elastic pressure on the flexible container and its contents.

While not wanting to be bound by theory, it is believed that the adapter of the present invention dynamically balances the centrifuge in the following manner. During the thawing of frozen material in centrifugation, the thinner sections of the flexible container, those near the hinge and latch as shown in FIG. 4, thaw first, with thawing proceeding progressively inwardly toward the center of the flexible container at line B—B. This is shown for the purpose of assisting understanding of the present invention only, by segmented regions 1–5 in FIG. 4. Thawing is believed to progress in order from regions 1 to regions 5. However, FIG. 4 should not be used to strictly limit the present invention to the particular thawing (e.g., size and shape of segments) shown in that figure. The thawing pattern is believed to be generally radially symmetric to the axis of revolution B—B of a swinging bucket. The crescent shaped adapter, by ordering the flow of frozen masses and liquids, eliminates mechanical imbalance that would otherwise occur during centrifugation due to the aleatory accumulation of liquid and solid masses.

In operation, a flexible container and its contents, such as a bag of whole blood, is processed as desired by centrifugation. At a desired point of the processing (such as in place of the "fast freeze slow thaw" step of platelet poor plasma shown in the brochure "Blood Component Therapy with RC-3", which is incorporated herein by reference) the flexible container is placed in the interior region of the adapter of the present invention. The latch is closed and its hook is inserted into one of the openings 34 which results in a desired size and the crescent shape of the interior region bounded by the adapter wall (or shape of a region between the high curvature concave wall and opposing low curvature wall). A desired amount of pressure is thus applied to the bag and shapes the bag. The flexible container and its contents are frozen in a known manner while contained by the adapter in the resultant shape. When needed for use the adapter and flexible container with its frozen contents are then placed in the carrier of a centrifuge and centrifuged at a speed and for a time sufficient to thaw the contents of the flexible container. Maintaining the frozen and thawing flexible container in a shape into which it is placed by the crescent shaped adapter wall (see the flexible container of FIG. 4), permits the contents of the flexible container to thaw uniformly without imbalance problems that would lead to damage to the centrifuge or injury to its operator due to rupture of the flexible container. After thawing, the adapter is removed from the carrier, the latch is opened and the first and second portions of the adapter are moved apart on the hinge. The flexible bag and its thawed (liquid) contents are removed from the adapter and ready for use and/or further processing (e.g., centrifugation to form Factor VIII rich Cryoprecipitate as shown in the RG-3 reference).

Many modifications and variations of the invention will be apparent to those of ordinary skill in the art in light of the foregoing disclosure. Therefore, it is to be understood that, within the scope of the appended claims, the invention can be practiced otherwise than has been specifically shown and described.

What is claimed is:

1. An adapter for supporting a flexible container in a cylindrical cavity of a centrifuge carrier, said adapter being of a size that can be received in said cavity and comprising a wall comprised of a flexible material, wherein said wall comprises a first concave wall portion having a first curvature and a second wall portion having a second curvature that is lower than said first curvature, said first wall portion being concave with reference to the flexible container and said second wall portion being convex with reference to the flexible container, said first wall portion and said second wall portion being diametrically opposed to each other so as to receive said flexible container in an interior region substantially bounded by an inner surface of said wall.

2. The adapter of claim 1 wherein said interior region has a crescent shape.

3. The adapter of claim 1 wherein said flexible material is comprised of sheet metal.

4. The adapter of claim 1 comprising a hinge fastened to said first wall portion and said second wall portion and a latch that adjustably interconnects said first wall portion and said second wall portion together.

5. The adapter of claim 4 wherein one of said first wall portion and said second wall portion includes a plurality of openings into which said latch can be received for varying the size of said interior region.

6. The adapter of claim 1 wherein said first wall portion has a radius of curvature that is 5 to 10 mm smaller than a radius of curvature of said cavity.

7. The adapter of claim 1 wherein said second wall portion has a radius of curvature ranging from 3 to 4 times the radius of curvature of said first wall portion.

8. An adapter for supporting a flexible container, and contents of said flexible container, in a cylindrical cavity of a centrifuge carrier, said adapter being of a size that can be received in said cavity and comprising a first section and a second section both comprised of a flexible material, said first section being diametrically opposed to said second section so as to enclose said flexible container in an interior region substantially bounded by an inner surface of said first section and an inner surface of said second section, a hinge fastened to said first section and said second section, and a latch that adjustably interconnects said first section and said second section together, wherein said first section has a first curvature and a concave shape and said second section has a second curvature which is lower than said first curvature, said first section being concave with regard to the flexible container, and one of said first section and said second section includes a plurality of openings in which said latch can be received.

9. The adapter of claim 8 wherein said flexible material is comprised of sheet metal.

10. The adapter of claim 8 wherein said interior region has a crescent shape.

11. The adapter of claim 8 wherein said second section is convex with reference to the flexible container.

12. The adapter of claim 8 wherein said material has a flexibility that allows a maximum linear distortion of either said first section or said second section ranging from 0.3 to 1.0 mm.

13. The adapter of claim 8 wherein said first section has a radius of curvature that is 5 to 10 mm smaller than a radius of curvature of said cavity.

14. The adapter of claim 8 wherein said second section has a radius of curvature ranging from 3 to 4 times the radius of curvature of said first section.

15. A centrifuge comprising a rotatable rotor, carrier members pivotally supported on said rotor, said carrier members each having structure defining a cylindrical cavity, and adapters for supporting a flexible container in said cavities, each said adapter being constructed and arranged to be disposed in said cylindrical cavity of said carrier, wherein each said adapter comprises a wall formed of a flexible material, wherein said wall comprises a first concave wall portion having a first curvature and a second convex wall portion having a second curvature which is lower than said first curvature, said first wall portion and said second wall portion being diametrically opposed to each other and enclosing said flexible container therebetween, said first wall portion being concave and said second wall portion being convex with regard to the flexible container.

16. An adapter for supporting a flexible container in a cylindrical cavity of a centrifuge carrier, said adapter being of a size that can be received in said cavity and comprising a wall comprised of a flexible material, wherein said wall comprises a first concave wall portion having a first curvature and a second wall portion having a second curvature that is lower than said first curvature, said first wall portion being concave with reference to the flexible container, said first wall portion and said second wall portion being diametrically opposed to each other so as to receive said flexible container in an interior region substantially bounded by an inner surface of said wall, wherein said interior region has a crescent shape.

17. The adapter of claim 16 wherein said second wall portion is convex with reference to the flexible container.

18. An adapter for supporting a flexible container in a cylindrical cavity of a centrifuge carrier, said adapter being of a size that can be received in said cavity and comprising:

a) a wall comprised of a flexible material, wherein said wall comprises a first concave wall portion having a first curvature and a second wall portion having a second curvature that is lower than said first curvature, said first wall portion being concave with reference to the flexible container, said first wall portion and said second wall portion being diametrically opposed to each other so as to receive said flexible container in an interior region substantially bounded by an inner surface of said wall;

b) a hinge fastened to said first wall portion and said second wall portion; and c) a latch that adjustably interconnects said first wall portion and said second wall portion together, wherein one of said first wall portion and said second wall portion includes a plurality of openings into which said latch can be received for varying the size of said interior region.

* * * * *